US007140891B1

(12) United States Patent
Huang et al.

(10) Patent No.: US 7,140,891 B1
(45) Date of Patent: Nov. 28, 2006

(54) DUSTPROOF RECEPTACLE CONNECTOR

(75) Inventors: Chung-Hsin Huang, Tu-Cheng (TW); Mei-Chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/445,246

(22) Filed: Jun. 2, 2006

(51) Int. Cl.
*H01R 13/44* (2006.01)
*H01R 13/648* (2006.01)

(52) U.S. Cl. ..... 439/137; 439/140; 439/607

(58) Field of Classification Search ..... 439/135–140, 439/141–142
See application file for complete search history.

(56) References Cited

U.S. PATENT DOCUMENTS 6,413,108 B1 * 7/2002 Centofante ..... 439/267
6,976,858 B1 * 12/2005 Kikuchi et al. ..... 439/140
2003/0119349 A1 * 6/2003 Bakker et al. ..... 439/140
2004/0132325 A1 * 7/2004 Yu et al. ..... 439/140
2004/0229484 A1 * 11/2004 Uchida ..... 439/137

* cited by examiner

*Primary Examiner*—Hien Vu
(74) *Attorney, Agent, or Firm*—Rosenberg, Klein & Lee

(57) ABSTRACT

A dustproof receptacle connector includes a dielectric housing having a cavity. A plurality of terminals and a dustproof means are received in the cavity. The back end of the dielectric housing is a closed end. A pair of guide grooves are defined in lateral sides of the cavity. The dustproof means includes a dustproof cover and a plurality of springs. The dustproof cover has a plate. A pair of arms extend from two opposite sides of the plate respectively. A pair of positioning pillars are defined in the inner side of the plate. The springs twine on the positioning pillars and the arms slide in the guide grooves. A block protrudes inwardly from the inner side of each arm respectively to increase the anti-stress intensity of the arms.

8 Claims, 5 Drawing Sheets

DUSTPROOF RECEPTACLE CONNECTOR

BACKGROUND OF THE INVENTION

1. Field of the Invention

The present invention relates to a receptacle connector, and in particular to a dustproof receptacle connector.

2. The Related Art

Electronic products are widely used more and more with the development of the technology of the electrons. Connectors are also widely used with the development of the technology of the electrons. However, terminals of the connectors are easily to be dirtied and degraded by the dust. So, a dustproof receptacle connector is needed urgently.

A conventional dustproof receptacle connector includes a dielectric housing, a plurality of terminals received in a cavity of the dielectric housing and a dustproof means assembled to a mouth of the cavity for preventing dust from entering into the cavity and degrading the terminals in the cavity. There is a guide groove in the two inner sides of the cavity respectively. The guide groove extends from the mouth of the cavity to the end of the cavity. The dustproof means includes a dustproof cover and a plurality of springs. The dustproof includes a plate. An arm extends from each side of the plate respectively. A plurality of positioning pillars are defined in the middle of the inner side of the plate. The dustproof means is received in the dielectric housing. The arms slide in the guide grooves. The end portion of the springs contact the rear wall of the cavity and the front portion of the springs twine on the positioning pillars.

In use, when the jack plugs into the dustproof receptacle connector at an angle, the dustproof cover will deviate from the guide groove for only one side of the jack receiving stress. And also one arm of the dustproof cover which receives more stress than the other arm of the dustproof cover will be easy to be deformed or broken. Furthermore, the unbalance stress which the dustproof cover received will lead the springs being compressed at a different degree. Therefore, the springs are easy to be over compressed so that the springs are deformed and result the dustproof cover out of use.

Furthermore, the bottom surfaces of the front terminals are lower than the bottom surfaces of the back terminals because the connectors exist positive and negative common difference during the procedure of making. When the connector welds with a printed circuit board, the front terminals contact the printed circuit board before the back terminals. Therefore, the front portion of the dustproof receptacle connector is easy to deviate from the printed circuit board for the back portion of the dustproof receptacle connector receiving a big force of the soldering. The assembling of the dustproof receptacle connector is influenced.

SUMMARY OF THE INVENTION

A first object of the present invention is to provide a dustproof receptacle connector which can not only prevent arms of a dustproof cover from being deformed but also prevent springs of a dustproof means from being over compressed.

A second object of the present invention is to provide a dustproof receptacle connector which can prevent the front portion of the dustproof receptacle connector from deviating from a printed circuit board.

In order to achieve the functions just as described, a dustproof receptacle connector according to the present invention includes a dielectric housing, a plurality of terminals and a dustproof means. The dielectric housing has a front mouth and a closed end. A cavity extends from the front mouth to the closed end. The guide groove is defined in each inner side of the cavity respectively. A plurality of plug holes are defined on the closed end. A plurality of terminals are received in the dielectric housing. Each terminal has a contacting portion, a plug portion and a soldering portion. The contacting portion is received in the cavity. The plug portion is received in the plug hole. The soldering portion extends out of the bottom surface of the dielectric housing. The dustproof means are received in the cavity of the dielectric housing. The dustproof means includes a dustproof cover and a plurality of springs. The dustproof cover includes a plate. An arm extends from the two sides of the plate respectively. A block protrudes inwardly from the inner side of each arm. A plurality of positioning pillars are formed in the middle of the inner side of the plate. The springs twine on the positioning pillars. The arms slide in the guide grooves. The end of the blocks contact the closed end of the dielectric housing. A pair of pads are defined on the bottom surface of the back portion of the dielectric housing. The bottom surface of the pads are below or equal to the bottom surfaces of the soldering portion of the terminals.

The dustproof receptacle connector increases the anti-stress intensity of the arms of the dustproof cover to prevent the arms from cracking for receiving unbalance tress, by utilizing the blocks. When the blocks contact the closed end of the dielectric housing, it will prevent the springs being over compressed. Furthermore, the dustproof receptacle connector utilizes the bottom surfaces of the pads being below or equal to the bottom surfaces of the terminals so as to prevent the front portion of the dielectric housing deviating from a printed circuit board during the soldering procedure.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE PREFERRED EMBODIMENT

Detailed description will hereunder be given of the preferred embodiment of a dustproof receptacle connector according to the present invention with reference to the accompanying drawings.

Figure 1:
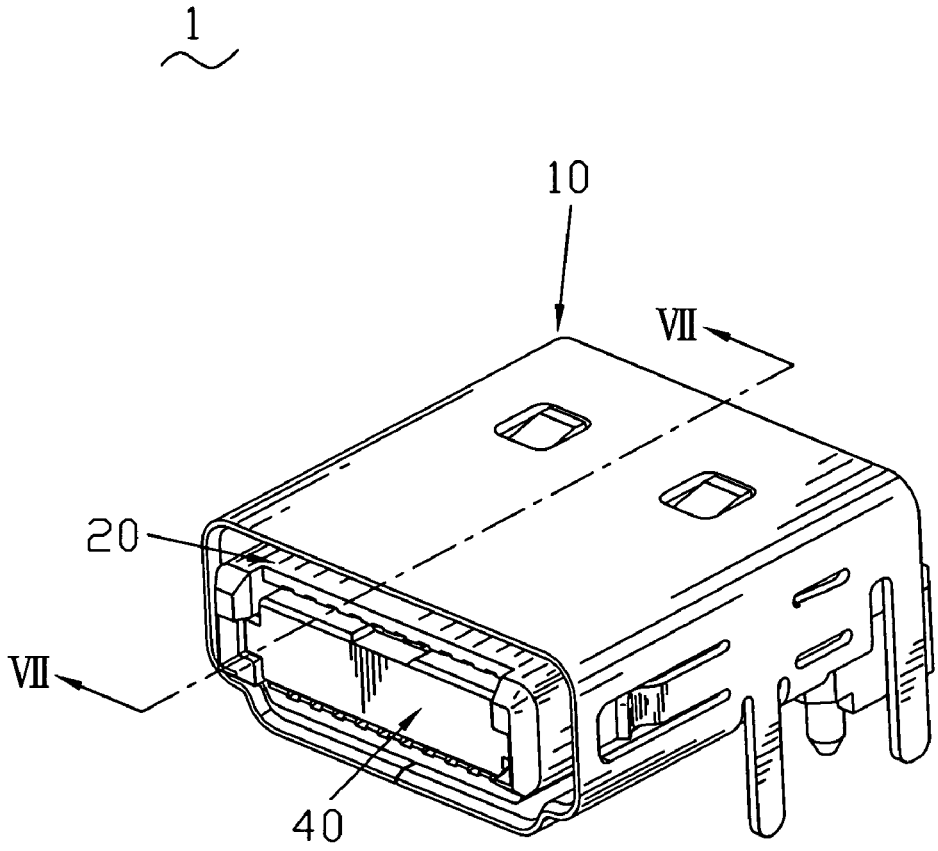
FIG. 1 is a perspective assembled view of a dustproof receptacle connector according to the invention.
Figure 2:
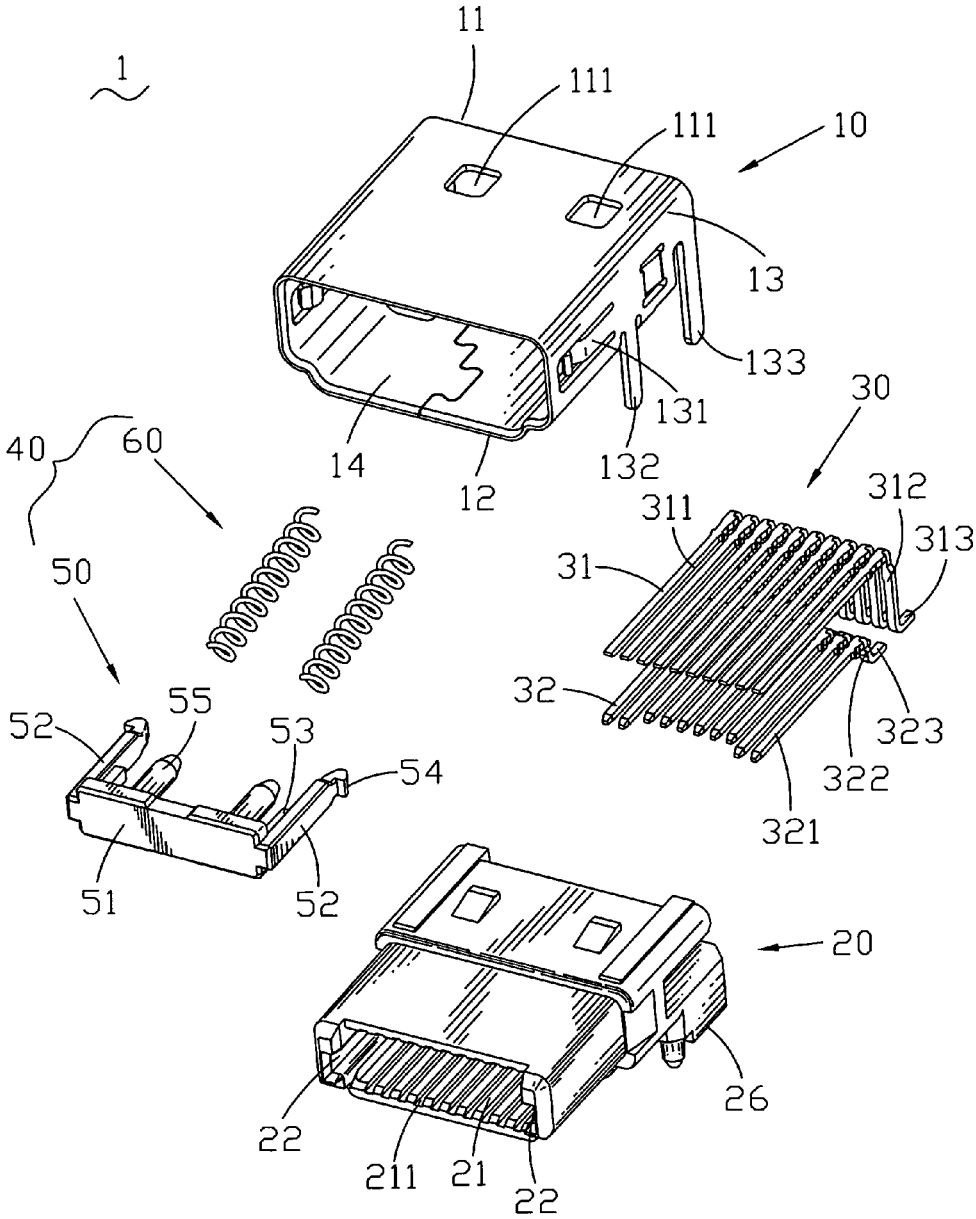
FIG. 2 is an exploded view of the dustproof receptacle connector according to the invention.

Please refer to FIG. 1 and FIG. 2. A dustproof receptacle connector 1 according to the present invention includes a cover 10, a dielectric housing 20 received in the cover, a plurality of terminals 30 which are received in the dielectric housing 20, and a dustproof means 40 received in the housing 20, too.

Referring to FIG. 2, the cover 10 includes a top plate 11, a bottom plate 12 paralleling to the top plate 11 and two side walls 13 vertically extending from the top plate 11 to the bottom plate 12. The top plate 11, the bottom plate 12 and the side walls 13 are assembled together to form a receiving cavity 14. A pair of holes 111 are formed on the back portion of the top plate 11. An elastic plate 131 is formed on the front portion of each side wall 13 respectively. A first plug leg 132 and a second plug leg 133 extend downwardly from the back portion of the side walls 13.

Figure 3:
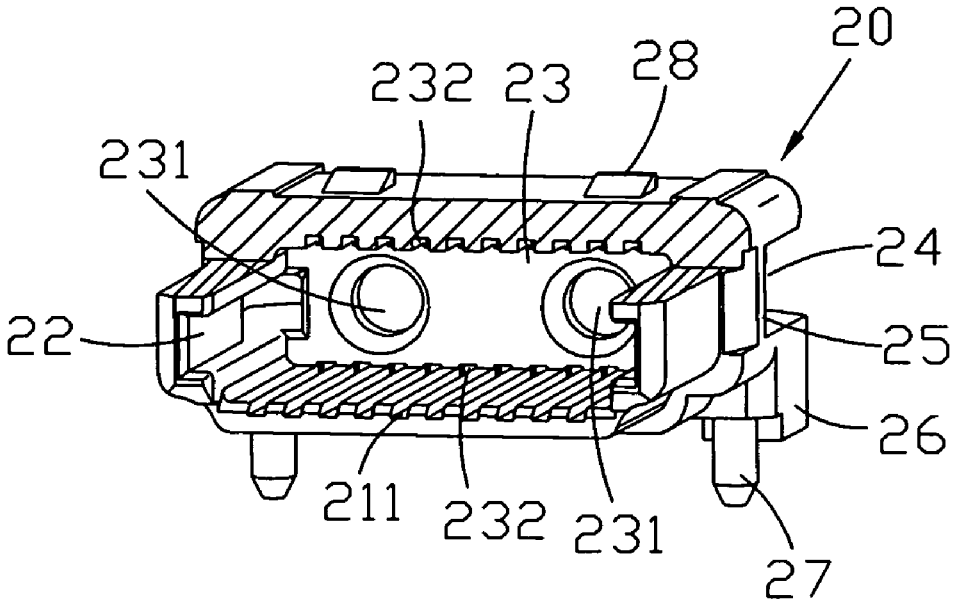
FIG. 3 is a partial cross-sectional view of a dielectric housing of the dustproof receptacle connector according to the invention as shown in FIG. 2.

Please refer to FIG. 2 and FIG. 3. FIG. 3 is a partial cross-sectional view of the dielectric housing 20 to show the inner structure of the dielectric housing 20. The dielectric housing 20 includes a front mouth and a closed end 23. A cavity 21 extends from the front mouth to the closed end 23. A pair of guide grooves 22 are defined on lateral sides of the cavity 21 respectively. A pair of positional holes 231 and two lines of plug holes 232 which are arranged to let the terminals 30 plug into are defined on the inner side of the closed end 23. A line of slots 211 are defined on the upper and down inner side of the cavity 21. The slots 211 are in accordance with the plug holes 232 respectively. The positional holes 231 states on the middle of the closed end 23. An open groove 24 is formed on the left side and right side of the back portion of the dielectric housing 20 respectively. The open groove 24 communicates with the guide groove 22. A stopper 25 is formed on the side wall of the dielectric housing 20 between the guide groove 22 and the open groove 24. A pad 26 protrudes from the bottom of the open groove 24 downwardly. The bottom surface of the pad 26 is below the bottom surface of the dielectric housing 20. A pair of fixed pillars 27 protrude from the bottom surface of the back portion of the dielectric housing 20. A pair of raised blocks 28 are defined on the back portion of the top plate of the dielectric housing 20.

Referring to FIG. 2, terminals 30 includes a first terminal 31 and a second terminal 32. The first terminal 31 includes a first contacting portion 311, a first plug portion 312 vertically extending from the first contacting portion 311, and a first soldering portion 313 horizontally extending from the first plug portion 312. The second terminal 32 includes a second contacting portion 321, a second plug portion 322 vertically extending from the second contacting portion 321, and a second soldering portion 323 horizontally extending from the second plug portion 322. The vertical length of the first plug portion 312 is longer than the vertical length of the second plug portion 322.

The dustproof means 40 includes a dustproof cover 50 and a plurality of springs 60. The dustproof cover 50 includes a plate 51. The size of the plate 51 is in accordance with the front mouth of the cavity 21 and can be fitted to the front mouth, sliding smoothly. A pair of arms 52 extend from two sides of the plate 51 respectively. A block 53 protrudes inwardly from the inner side of each arm 52 respectively. The front portion of the blocks 53 connect with the plate 51. There is a certain distance between the back portion of the blocks 53 and the end portion of the arms 52. A clasp 54 protrudes outwardly from the end of the each arm 52 respectively. A pair of positional pillars 55 are defined one the inner side of the plate 51 and protrude backwardly.

Figure 4:
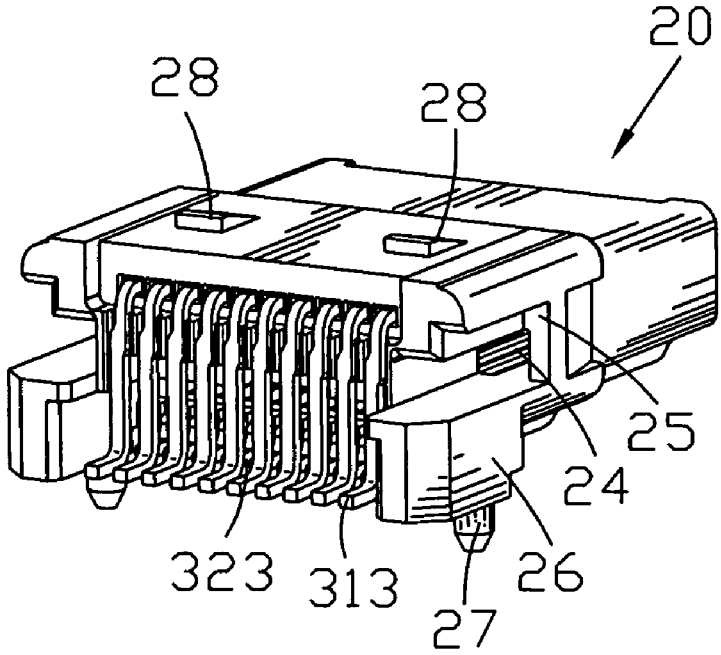
FIG. 4 is a back view of a partly assembled view of the dustproof receptacle connector of the present invention showing a plurality of terminals assembled to the dielectric housing.

Please refer to FIG. 3 and FIG. 4. The first contacting portion 311 of the first terminal 31 are received in the slots 211 which are defined in the upper inner side of the cavity 21 though the upper line of the plug holes 232. The first plug portion 312 and the first soldering portion 313 protrude outwardly though the upper line of the plug holes 232. The second contacting portion 321 of the second terminal 32 are received in the slots 211 which are defined in the down inner side of the cavity 21 though the other line of plug holes 232. The second soldering portion 323 protrude outwardly though the other line of the plug holes 232. The second soldering portion 323 is on the front of the first soldering portion 313 (as show in FIG. 2). The first soldering portion 313 and the second soldering portion 323 are arranged in two lines to weld with a printed circuit board. The bottom surface of the first soldering portion 313 is equal to the bottom surface of the second soldering portion 323.

Referring to FIG. 4, the bottom surface of the first soldering portion 313 is higher than the bottom surface of the second soldering portion 323 because of the positive and negative common differences which exist during the procedure of making. The bottom surface of the pad 26 is below the bottom surface of the second soldering portion 323. Furthermore, the bottom surface of the pad 26 can also be equal to the bottom surface of the second soldering portion 323.

Figure 5:
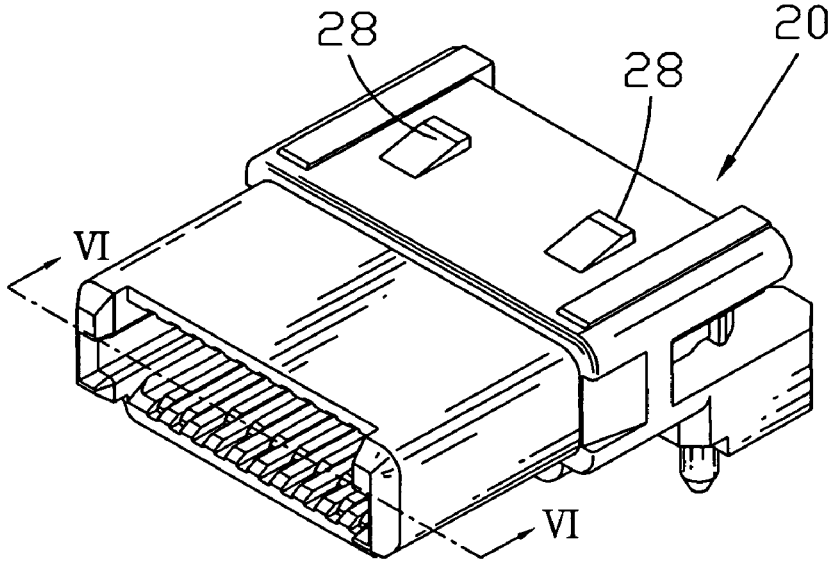
FIG. 5 is a partly assembled view of the dustproof receptacle connector of the present invention showing a dustproof means assembled to the dielectric housing.
Figure 6:
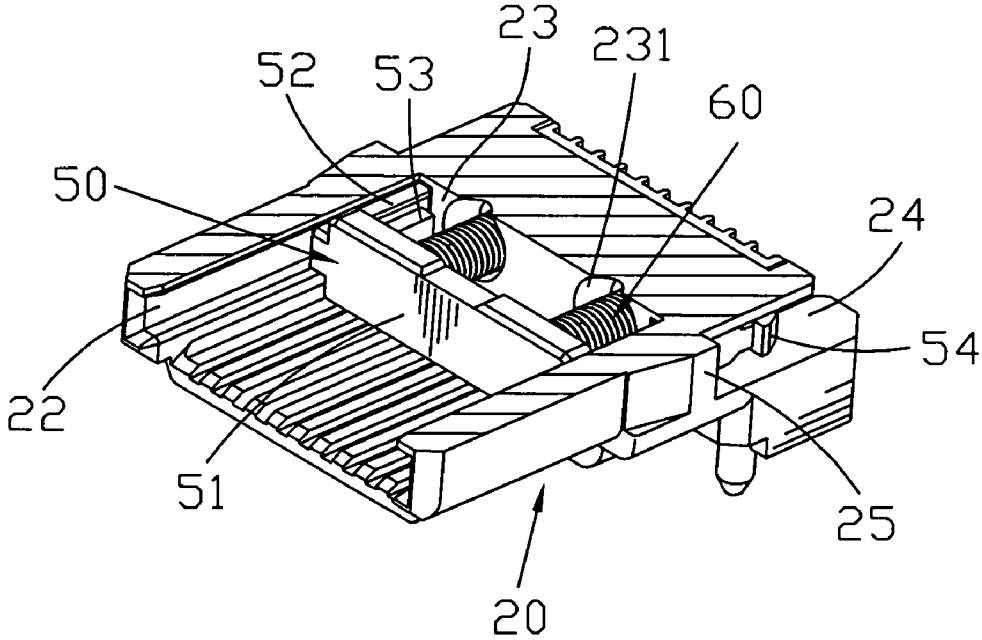
FIG. 6 is a cross-sectional view of FIG. 5 taken along VI—VI.

Please refer to FIG. 5 and FIG. 6. The springs 60 twine on the positioning pillars 55 of the dustproof cover 50. The clasps 54 slide into the dielectric housing 20 along the guide grooves 22. The plate 51 enters into cavity 21 of the dielectric housing 20 through the front mouth. Push the plate 51 so as to make the clasps 54 slide backwardly in the guide grooves 22 continually until the clasps 54 slide into the open grooves 24 of the dielectric housing 20 and protrude outwardly. The stopper 25 is provided for the clasps 54 to hook on so as to prevent the dustproof cover 50 from moving frontward. At this moment, the end of the springs 60 and the positional pillars 55 are received in the positional holes 231. Then, put the dielectric housing 20 into the cover 10. The raised blocks 28 insert into the holes 111. At this time, the assembling of the dustproof receptacle connector 1 is finished.

When the dustproof receptacle connector 1 connect with a modular jack, the dustproof cover 50 slides backwardly in the cavity 21 for receiving a pushing force from the jack. The arms 52 also slide in the guide grooves 22 and contact the inner side of the guide groove 22 all the time. At the same time, the clasps 54 slide in the open grooves 24. The springs 60 are deformed gradually by the pushing of the dustproof cover 50. When the springs 60 are compressed at a certain degree, the blocks 53 of the dustproof cover 50 contact the closed end 23 of the dielectric housing 20 to prevent the springs being over compressed. The blocks 53 increase the anti-stress intensity of the arms 52 of the dustproof cover 50 to prevent the arms 52 cracking for receiving an unbalance stress.

Figure 7:
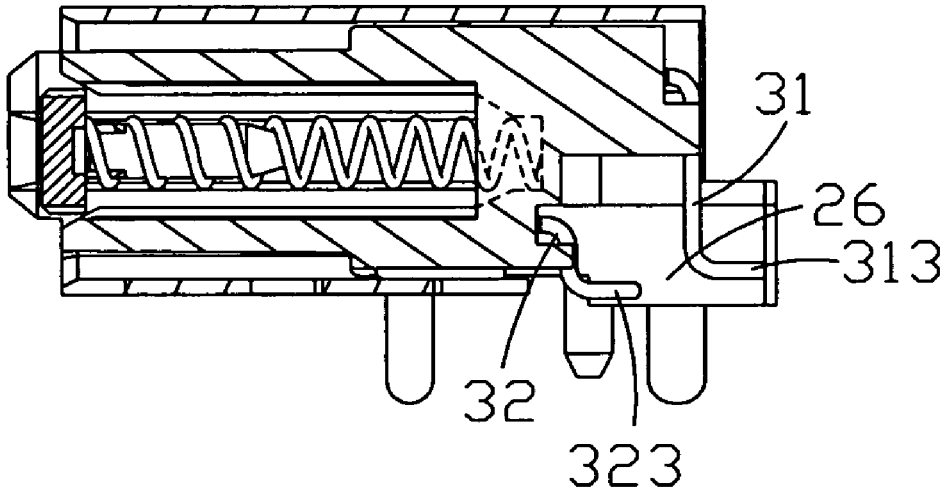
FIG. 7 is a cross-sectional view of a plan view of FIG. 1 taken along VII—VII.

Please refer to FIG. 7. When the terminals 30 welds with a printed circuit board, the pads 26 contact the printed circuit board first, then the first soldering portion 313 and the second soldering portion 323 weld with the printed circuit board because the bottom surface of the pads 26 is below the lower bottom surface of the first soldering portion 313 and the second soldering portion 323. Therefore, the front portion of the dustproof receptacle connector 1 won't deviate from the printed circuit board, and the first soldering portion 313 and the second soldering portion 323 receive stress in equilibrium. In fact, the bottom surfaces of the pads 26 also can be designed by equality to the bottom surface of the first soldering portion 313 and the second soldering portion 323. For example, the bottom surface of the pads 26 can be designed to be equal to the lower bottom surface of the first soldering portion 313 and the second soldering portion 323.

As described hereinabove, the dustproof receptacle connector 1 utilizes adding the blocks 53 in the inner side of the arms 52 to prevent the springs 60 from being over compressed and the arms 52 cracking so as to achieve a good function of preventing the dust entering into the cavity 21. Furthermore, the dustproof receptacle connector 1 utilizes the bottom surfaces of the pads 26 being below the first soldering portion 313 and the second soldering portion 323 or equal to the lower bottom surface of the first soldering portion 313 and the second soldering portion 323 to prevent the front portion of the dustproof receptacle connector 1 deviating from the printed circuit board.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A dustproof receptacle connector, comprising:

a dielectric housing having a front mouth and a closed end, a cavity extending from the front mouth to the closed end, a pair of guide grooves defined in lateral sides of the cavity, a plurality of plug holes defined on the closed end;

a plurality of terminals received in the dielectric housing, each terminal having a contacting portion received in the cavity of the dielectric housing, a plug portion inserting into the plug holes and a soldering portion extending out of the dielectric housing; and a dustproof means received in the cavity, the dustproof means including a dustproof cover and a plurality of springs, the dustproof cover having a plate, a pair of arms extending from two opposite sides of the plate respectively and received in the guide groove, a block protruding inwardly from the inner side of each arm, the front portion of the blocks connecting with the plate, the back portion of the blocks keeping a certain distance away from the end portion of the arms, a pair of positional pillars protruding backwardly from the inner side of the plate to be accommodated by positional holes inside the closed end, the springs twining on the positioning pillars.

2. The dustproof receptacle connector as claimed in claim 1, wherein the soldering portion of the terminal extends from the plug portion of the terminal; a pad protrudes downwardly from each side of the back portion of the dielectric housing respectively; and the bottom surfaces of the pads are below the bottom surface of the soldering portion.

3. The dustproof receptacle connector as claimed in claim 1, wherein the soldering portion of the terminal extends from the plug portion of the terminal; a pad protrudes downwardly from each side of the back portion of the dielectric housing respectively; and the bottom surfaces of the pads are equal to the lowest bottom surface of the soldering portion.

4. The dustproof receptacle connector as claimed in claim 1, wherein an open groove is formed on the left side and right side of the back portion of the dielectric housing respectively; the open groove communicates with the guide groove; a stopper is formed on the side wall of the dielectric housing between the guide groove and the open groove; a clasp protrudes outwardly from the end of each arm respectively, and contacts the stopper to prevent the dustproof cover moving frontward.

5. The dustproof receptacle connector as claimed in claim 1, wherein the dustproof receptacle connector further comprises a cover, and the dielectric housing is received in the cover.

6. The dustproof receptacle connector as claimed in claim 1, wherein the terminals comprise a first terminal and a second terminal; the first terminal comprises a first contacting portion, a first plug portion and a first soldering portion; the second terminal comprises a second contacting portion, a second plug portion and a second soldering portion; the first contacting portion and the second contacting portion are received in the upper and down inner side of the dielectric housing respectively; and the first soldering portion and the second soldering portion protrude out of the dielectric housing.

7. The dustproof receptacle connector as claimed in claim 6, wherein the first soldering portion extends from the first plug portion; the second soldering portion extends from the second plug portion; a pad protrudes downwardly from each side of the back portion of the dielectric housing respectively; and the bottom surfaces of the pads are below the lower bottom surface of the first soldering portion and the second soldering portion.

8. The dustproof connector as claimed in claim 6, wherein the first soldering portion extends from the first plug portion; the second soldering portion extends from the second plug portion; a pad protrudes downwardly from each side of the back portion of the dielectric housing respectively; and the bottom surfaces of the pads are equal to the lower bottom surface of the first soldering portion and the second soldering portion.

* * * * *